US010731283B2

(12) United States Patent
Franco

(10) Patent No.: US 10,731,283 B2
(45) Date of Patent: Aug. 4, 2020

(54) CAGE FOR THE FRICTION RING OF A DAMPER FOR VERTICAL AXIS WASHING MACHINES

(71) Applicant: C.I.M.A. Compagnia Italiana Molle Acciaio S.p.A., Busnago (MB) (IT)

(72) Inventor: Andrea Franco, Busnago (IT)

(73) Assignee: C.I.M.A. Compagnia Italiana Molle Acciaio S.p.A., Busnago (MB) (IT)

( * ) Notice: Subject to any disclaimer, the term of this patent is extended or adjusted under 35 U.S.C. 154(b) by 4 days.

(21) Appl. No.: 16/075,542

(22) PCT Filed: Jan. 27, 2017

(86) PCT No.: PCT/IB2017/050439

§ 371 (c)(1),
(2) Date: Aug. 3, 2018

(87) PCT Pub. No.: WO2010/103349

PCT Pub. Date: Sep. 16, 2010

(65) Prior Publication Data

US 2019/0040566 A1 Feb. 7, 2019

(30) Foreign Application Priority Data

Feb. 25, 2016 (IT) ..... 102016000019384

(51) Int. Cl.

| | |
|---|---|
| ***D06F 37/24*** | (2006.01) |
| ***D06F 37/20*** | (2006.01) |
| ***F16F 13/00*** | (2006.01) |
| ***F16F 7/09*** | (2006.01) |

(52) U.S. Cl.
CPC ..... *D06F 37/24* (2013.01); *D06F 37/20* (2013.01)

(58) Field of Classification Search
CPC .. F16F 7/09; F16F 13/00; D06F 37/24; B60G 13/02; B60G 2202/23
USPC ..... 188/381
See application file for complete search history.

(56) References Cited

U.S. PATENT DOCUMENTS 3,503,472 A * 3/1970 Axthammer ..... A47B 9/10 188/269
4,474,273 A * 10/1984 Le Pierres ..... F16F 7/04 188/129
5,961,105 A * 10/1999 Ehrnsberger ..... F16F 7/09 267/216

(Continued)

FOREIGN PATENT DOCUMENTS

WO WO2010/103349 9/2010

*Primary Examiner* — Thomas J Williams
*Assistant Examiner* — James K Hsiao
(74) *Attorney, Agent, or Firm* — R. Ruschena Patent Agent, LLC

(57) ABSTRACT

Cage (5) for containing the friction ring (6) of dampers for vertical axis washing machines, said cage comprising a through inner recess, configured to house slidingly the rod of the damper, and to contain a friction ring, characterized in that said through inner recess is subdivided in three parts: a first part (52) in which said recess is provided with a plurality of inner tongues therein; a second part (53) with circular section and such axial diameter and length that the friction ring is housed; a third part (54) in which said recess is provided with a plurality of tabs therein, and in that said tongues (521) and said tabs (541) are not overlapped with respect to each other, in front view.

5 Claims, 6 Drawing Sheets

(56) References Cited

U.S. PATENT DOCUMENTS

| | | | | |
|---|---|---|---|---|
| 6,264,014 | B1 * | 7/2001 | Ferlicca | D06F 37/20 188/129 |
| 7,341,132 | B2 * | 3/2008 | Peuker | D06F 37/20 188/322.17 |
| 7,971,693 | B2 * | 7/2011 | Peuker | D06F 37/22 188/381 |
| 9,297,434 | B2 * | 3/2016 | Kanioz | F16F 7/09 |
| 9,476,154 | B2 * | 10/2016 | Mantri | D06F 37/245 |
| 9,963,814 | B2 * | 5/2018 | Kim | D06F 37/264 |
| 2005/0224303 | A1 * | 10/2005 | Park | D06F 37/20 188/322.15 |
| 2011/0247372 | A1 * | 10/2011 | Miller | D06F 37/12 68/13 R |
| 2011/0259688 | A1 * | 10/2011 | Kanioz | F16F 7/09 188/381 |
| 2015/0020551 | A1 * | 1/2015 | Yu | D06F 37/265 68/23.3 |
| 2016/0024705 | A1 * | 1/2016 | Hernden | D06F 37/24 267/140.13 |
| 2017/0268148 | A1 * | 9/2017 | Davis | D06F 37/268 |

* cited by examiner

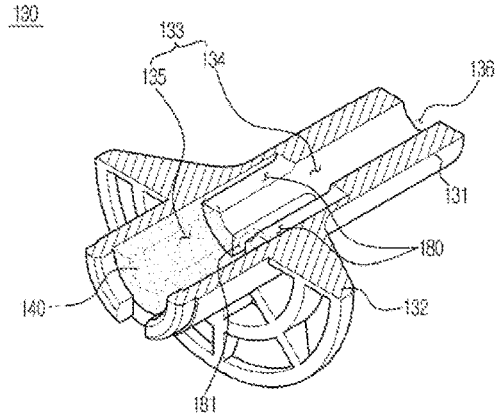
Fig. 1 – Prior art
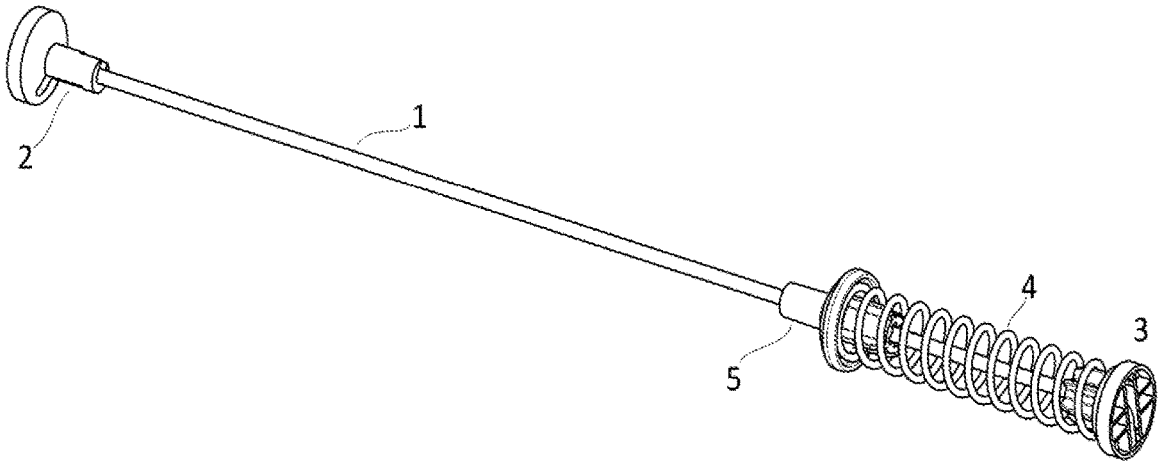
Fig.2

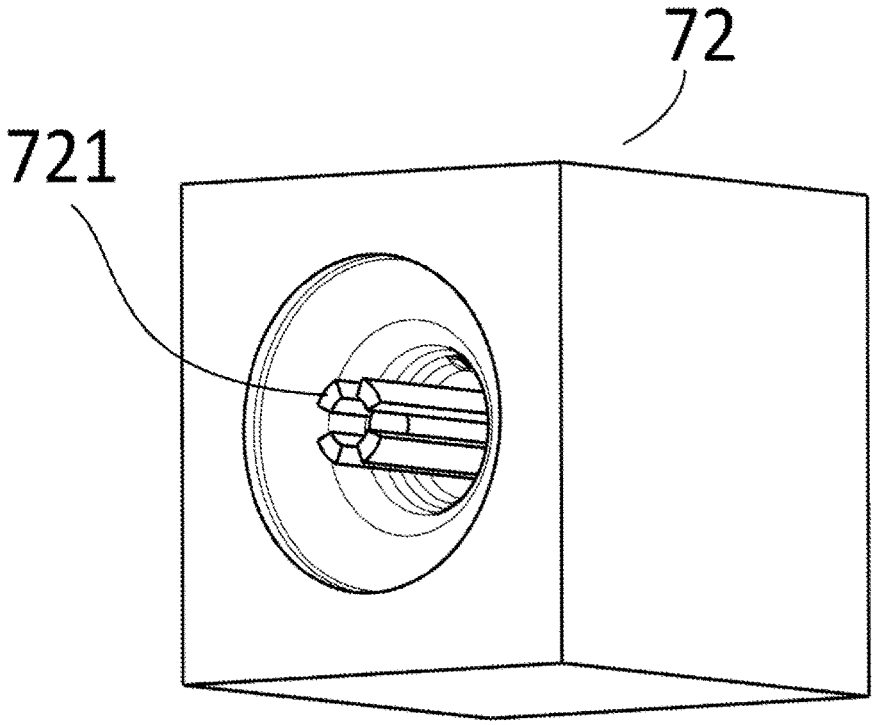
Fig. 9
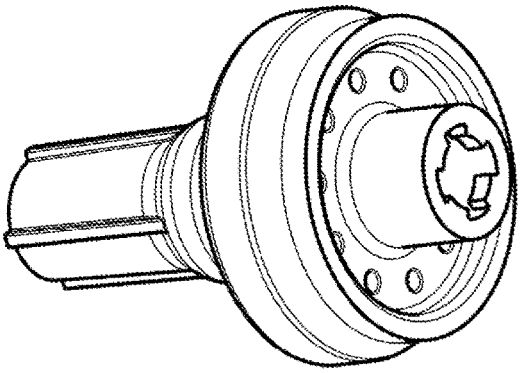
Fig. 10-a
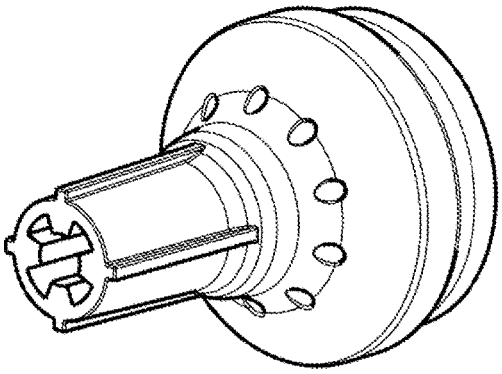
Fig. 10-b

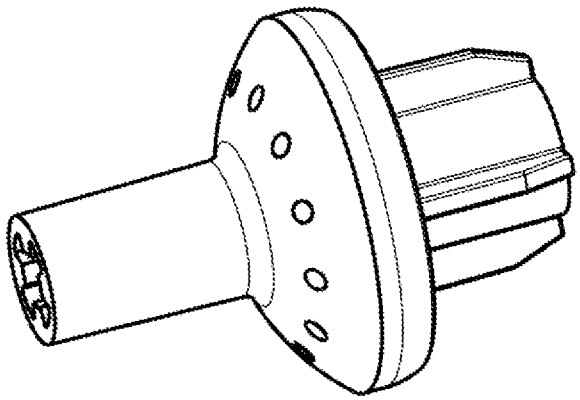
Fig. 11-a
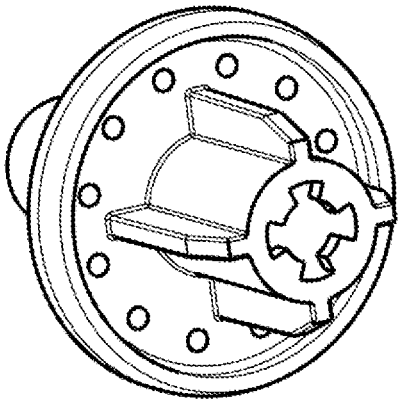
Fig. 11-b

CAGE FOR THE FRICTION RING OF A DAMPER FOR VERTICAL AXIS WASHING MACHINES

RELATED APPLICATIONS

This is a national stage application of PCT application PCT PCT/IB2017/050439 having an international filing Date of Jan. 27, 2017. This application claims foreign priority based on application 102016000019384 of Italy, filed on Feb. 25, 2016.

BACKGROUND OF THE INVENTION

The present invention relates to a cage for containing a friction ring to be used in a damper for vertical axis washing machines. The invention provides also a damper for vertical axis washing machines, comprising said cage.

1. Field of the Invention

At the state of the art it is known the use of vertical axis washing machines, in which the drum is constrained to a frame by means of dampers. Said dampers comprise a rod whose first end is constrained to the drum of the washing machine. The rod slides with respect to a cage containing a friction ring, and the cage is integrally constrained to the frame of the washing machine. The damper is configured so that, when drum vibrations cause the drum to move away from the frame, the rod compresses a spring constrained between the second end of the rod and the cage, and slides with respect to the friction ring: in this way, elastic and friction forces are applied to the drum, which forces, suitably dimensioned, allow the correct functioning of the washing machine, thus limiting the movements of the drum.

2. Brief Description of the Prior Art

Some embodiments of dampers realized according to this logic are shown in documents EP2377983, KR20150081742, U.S. Pat. Nos. 5,117,659, 6,397,643, WO2010/103349. There is also a variant of this kind of dampers. They are dampers comprising a "shell" in which friction is provided between an outer shell (in which it also is provided a spring) and a ring (or other element) integral to the rod.

Among the dampers of the first kind, those where friction is exerted between a ring contained inside a suitable cage and the rod, it is to be précised that the cage is commonly realized in plastic material and, since this kind of elements is produced in great number, the technology used is the molding one. This technology is in fact commonly used for realizing great series of plastic pieces.

Almost in every embodiment known at the state of the art (as the one shown in EP2377983) the cage is realized in two pieces, which are assembled only after introducing the friction ring there inside. This embodiment of cage has the drawback that it requires the realization of more molds (a mold for each piece constituting the cage), and the need to assemble, for each damper, a cage in two pieces. While being apparently simple, these operations are carried out for a huge number of pieces, and their carrying out is disadvantageous.

In other embodiments, as for example those shown in documents KR20150081742 and U.S. Pat. No. 6,397,643 it is described the realization of cages for friction ring realized in only one piece, which however have some drawbacks.

In particular, the solution shown in U.S. Pat. No. 6,397,643 requires the usage of a complex shaped friction ring, comprising tongues arranged on the outer surface of the same ring, configured to be engaged in suitable openings provided inside the cage. It is clear that now the complexity of the technical solution is moved from the cage to the friction ring.

The solution described in KR20150081742 is instead shown in the appended FIG. 1 and represents, at the best knowledge of the today's inventors, the closest prior art with respect to the proposed invention. With reference to the appended FIG. 1, it is to be noted that in KR20150081742 the friction ring (140) is introduced by forcing from the left side. After introducing the friction ring, the rod and the remaining pieces are introduced according to what just described. As it will be clearer after the description of the solution object of the present invention, the embodiment shown in KR20150081742 has some drawbacks which, while not having effect on the functioning of the piece when it is realized and assembled, make its realization complex from the molding point of view.

In particular, for realizing the groove inside which the friction ring is introduced (dashed in FIG. 1), it is needed to have an opening with great circumference on the front side. This is to allow a molding male to be introduced, which has to be of more pieces kind. This need imposes another constraint on the dimensions of the opening and inner groove, since the introduction geometric condition of the male in more pieces has to be verified.

SUMMARY OF THE INVENTION

Therefore, aim of the present invention is to provide a cage for friction ring to be used in dampers for vertical axis washing machines, which can be realized by molding in only one piece, in a simpler way than what happens in the embodiments known at the state of the art.

According to another aim, the present invention provides a damper for vertical axis washing machines, comprising a cage for friction ring which can be realized as only one piece and in a simpler way than what happens in the embodiments known at the state of the art, and in particular which can be realized by means of a two pieces mold, without needing males which can be disassembled or other complications of the production process.

Therefore, the present invention provides a cage for containing the friction ring of dampers for vertical axis washing machines, said cage comprising a through inner recess, configured to house slidingly the rod of the damper, and to contain a friction ring, characterized in that said through inner recess is subdivided in three parts: a first part in which said recess is provided with a plurality of inner tongues therein; a second part with circular section and such axial diameter and length that the friction ring is housed; a third part in which said recess is provided with a plurality of tabs therein, and in that said tongues (521) and said tabs (541) are not overlapped to each other, in a front view.

BRIEF DESCRIPTION OF THE DRAWINGS

The invention will be now described in detail with reference to the appended FIGS. 1 to 9. In FIG. 1 it is shown an embodiment of a cage for friction ring, known at the state of the art, taken from the document KR20150081742; in FIG. 2 it is shown a damper according to the present invention; in FIGS. 8 and 9 there is shown a preferred embodiment of the mold for realizing the cage according the present invention. In FIGS. 10 and 11 there are shown, in front and rear axonometric views, other two embodiments of the cage according to the present invention.

DETAILED DESCRIPTION OF THE PREFERRED EMBODIMENTS

Figure 3:
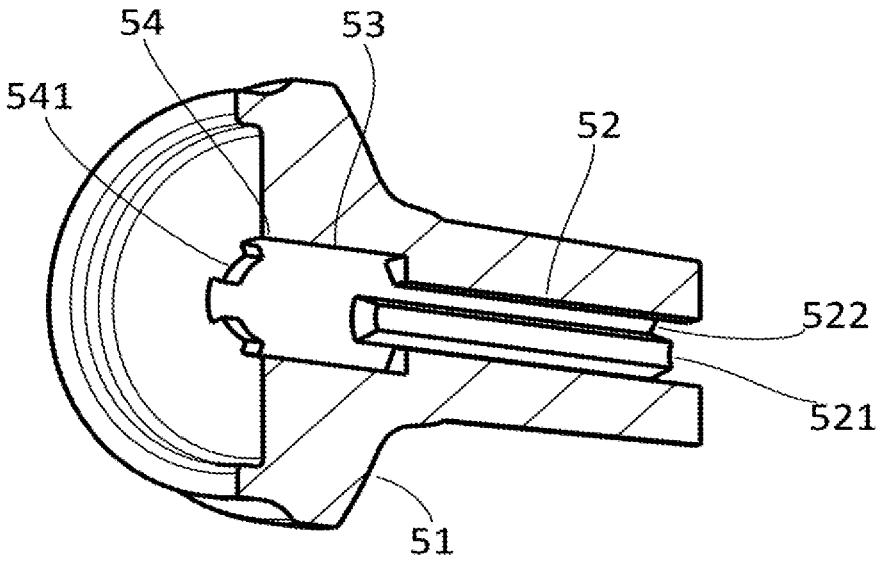
in FIG. 3 it is shown a section axonometric view of a first preferred embodiment of the cage according to the present invention.

With reference to FIG. 2, the damper according to the invention comprises a rod (1), constrained at a first end to a constraining means (2), configured to be coupled in a respective housing provided on the frame of a vertical axis washing machine or on the drum of the same. The rod (1) is slidingly introduced in a cage (5) which is provided with a surface (51) facing said constraining means (2) and configured to engage in a respective housing provided on the drum or frame of a vertical axis washing machine. The second end of the rod (1) is constrained to a stop (3), and between the stop (3) and the cage (5) it is introduced a spiral spring (4). When the damper is mounted on the washing machine, the spring (4) is partially compressed by the cage (5), and exerts the force needed to keep the constraining means (2) and the cage (5) in position inside their own housings.

Figure 4:
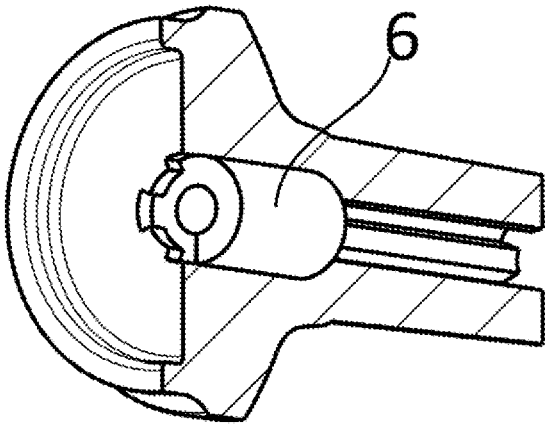
in FIG. 4 it is shown a section axonometric view of the cage containing the friction ring (not in section). The cage is shown in front view in FIG. 5.

As it is shown in FIG. 4, inside the cage (5) it is provided a friction ring (6), configured so that it cannot move axially with respect to the cage (5) and have a friction inner surface in contact to the rod (1), so that it exerts a friction force opposite to the respective movement between rod and cage, and thus damps vibrations of the drum of the washing machines. Preferably, as it is shown in FIG. 4, the friction ring (6) is made up of a strip in flexible plastic material (preferably polyurethane), folded on itself and introduced in the suitable recess of the cage (5). After the description of the pieces making up the damper, it is possible to describe in detail the cage (5) according to the present invention, stating firstly that for axial direction it is meant the direction in which the rod (1) can slide with respect to the cage (5).

The cage (5) has an outer axial-symmetrical shape and is provided with a through inner recess, configured for housing slidingly the rod (1) and for containing, positioned around the rod (1), a friction ring (6) which does not slide in axial direction with respect to the cage (5).

In particular, as it is clear from the figures, the friction ring (6) cannot slide in axial direction with respect to the cage (5) because it is kept in position by inner tongues (521) and tabs (541), which will be described in detail in the following.

Said through inner recess is subdivided in three parts.

In a first part (52) the recess has circular shape of diameter equal to the outer diameter of the friction ring, and it is provided with a plurality of inner tongues (521) thereinside, with circular crown sector section shape. The shape of the tongues (521) is such that the inner surfaces of said tongues are on a circular surface of such dimensions that the rod (1) is allowed to slide. As it is clear from the figures, between two adjacent tongues (521) a free space (522) remains whose utility for the realization process will be clear in the following. Moreover, having the shape of circular crown sector, the tongues (521) have side surfaces oriented in radial direction, ideally convergent to the axis of symmetry of the cage (5). In their terminal section the inner tongues (521) define a first abutting surface which limits the axial movement of the friction ring (6) inside the cage (5).

The second part (53) of the through inner recess has circular section and such axial diameter and length to house the friction ring (6), as it is shown for example in FIG. 4.

The third part (54) of the inner recess is provided instead with a plurality of tabs (541) which reduce its diameter and act as second axial abutting surface for the friction ring (6). Also the tabs (541) have the shape of circular crown sector, and so have their side surfaces oriented in radial direction, ideally convergent to the axis of symmetry of the cage (5). Thus, the position of the friction ring (6), once it is introduced inside the cage (5), is defined in axial direction from the tabs (541) and the tongues (521).

As stated, both the tongues (521) and the tabs (541) have the shape of circular crown sector, in front view.

The peculiarity of the cage (5) according to the present invention is that the angles relative to the circular sectors of tongues (521) and tabs (541) are not overlapped with respect to each other in front view, while the inner radius of the circular sectors of tongues and tabs can be different.

Figure 5:
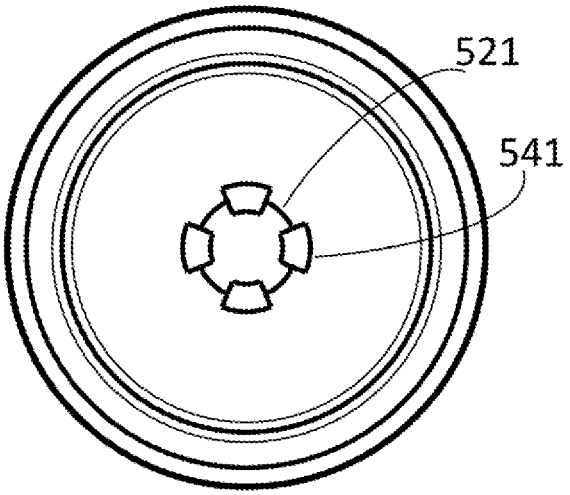
Figure 6:
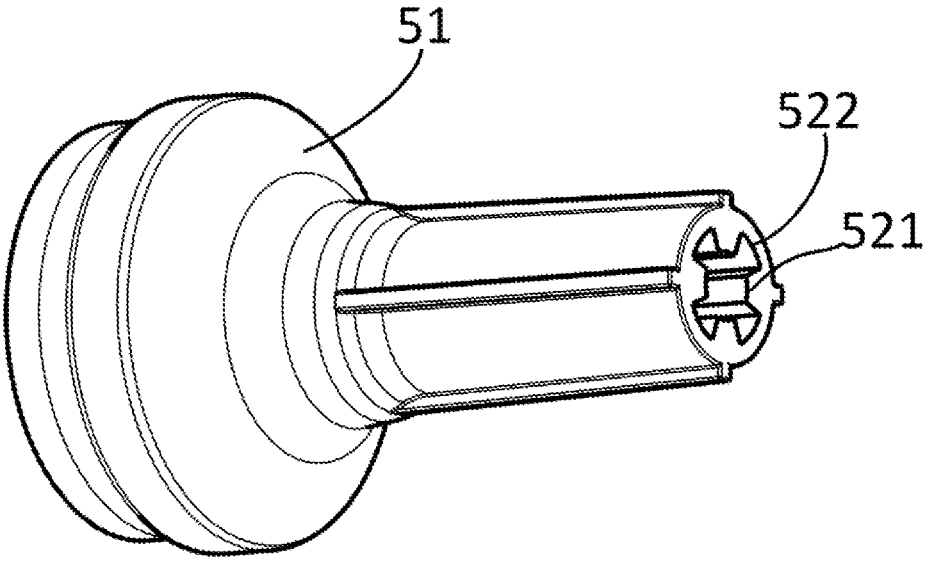
In FIGS. 6 and 7 there are shown two axonometric views of a preferred embodiment of the cage according to the present invention.
Figure 7:
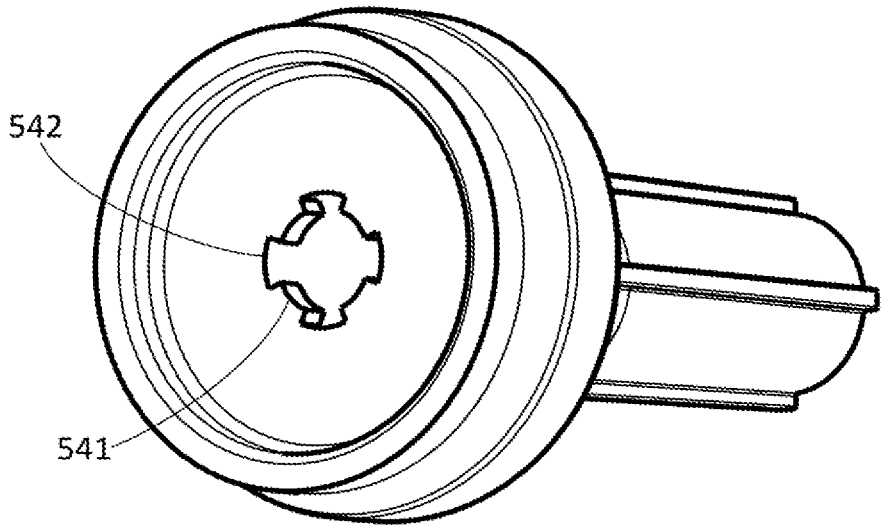

In an embodiment such angles are complementary to the circumference. This geometric feature is clear from the front view of FIG. 5, where it is shown how to free angles between consecutive tongues (521) the spaces occupied by respective tabs (541) correspond. Similarly, the free angles between consecutive tabs (541) correspond exactly to the angles occupied by the tongues (521). In other words, tabs (541) and tongues (521) are not overlapped in front view, regardless of how the inner radius of the circular crown sector is defined for both. But at the same time, in front view, the angular dimension of tabs and tongues is such that it takes the whole circumference.

In another embodiment the angles relative to the circular sectors of tongues (521) and tabs (541), always not overlapped to each other in front view, do not occupy the whole circumference. In other words, the free angles between consecutive tabs (541) have greater amplitude than the angles occupied by tongues (521), and vice versa. Preferably, in this case the tongues (521) are positioned so that they are, in front view, centered with respect to the free angles between consecutive tabs (541), and vice versa.

It is to be précised that the fact that the shape of tongues and tabs is the one of a circular crown sector is only a preferred embodiment, the only constraint for the effective realization of the piece being that the shape and position of said tongues (521) and tabs (541) is such that, in front view, the tongues and tabs are not overlapped, the tongues being positioned in the free space between two adjacent tabs and vice versa.

For realizing the cage according to the present invention, this geometric feature allows to use a mold realized in two parts which come closer with only an axial movement, without needing males or other pieces. Clearly, also the outer surface of the cage (5) is configured so that it has no undercuts and so that it can be realized according to common molding techniques.

Figure 8:
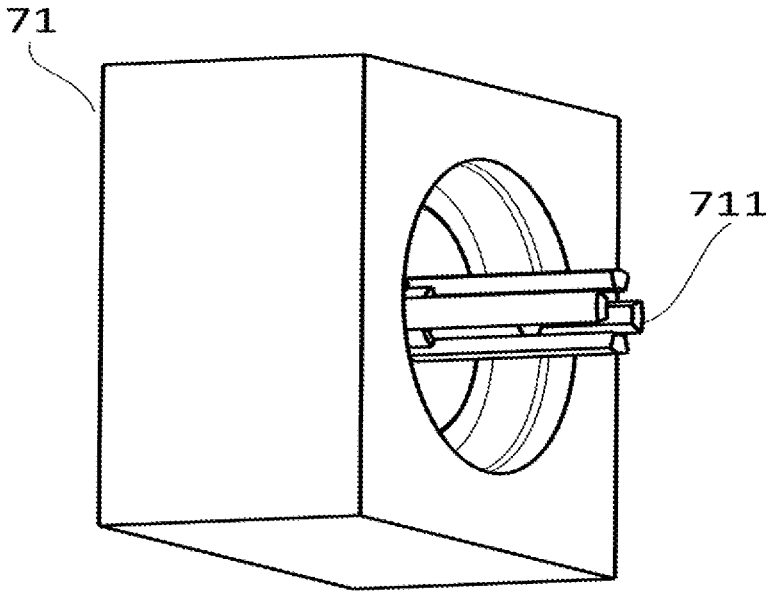

In addition, conveniently the tongues and possibly also the tabs can be tapered so that they have an angle which facilitates the withdrawal operations on their side surfaces, according to what commonly realized in the molding technique. In this case, the just described geometric considerations are to be referred to the front dimensions of tongues and tabs, measured in the respective sections of maximum angular dimension, and namely in the abutting sections with friction ring. An embodiment example of the mold for realizing the piece is shown in FIGS. 8 and 9. As it can be noted the mold is made up of a first (71) and a second part (72). The first part (71) of the mold comprises a series of projections (711) at the spaces between adjacent tongues, and the length of such projections (711) is such that it ends at the terminal surface of the tongues (521). The second part of the mold (72) comprises a second series of projections (721) at the free spaces (522) between adjacent tongues (521). When the two halves of the mold come closer, there is no interference between the first (711) and the second series of projections (721) since, as yet said, the tongues and the tabs are not overlapped, in front view.

Thus, it is possible to realize a cage (5) according to what described with a two pieces mold, only because the abutting surfaces of the friction ring are not constituted by full circumferences, as in all the embodiments known at the state of the art, but by circular crown sectors complementary to each other.

According to a preferred embodiment shown in figure, both the tongues and the tabs are four in number, anyway embodiments with different number of tongues and tabs can be realized without departing from the scope of the invention.

Concerning the embodiments known at the state of the art, in the cage (5) for dampers according to the present invention it is possible to define substantially arbitrarily the dimensions of the inner radii of the recess relative to the friction ring, the tongues and tabs, since it is not needed to verify any geometric condition for the introduction of a male in more pieces, in molding step. Moreover, the molding technique for realizing the piece is faster and cheaper than what happens at the state of the art.

The invention claimed is:

1. A cage (5) containing a friction ring of dampers for vertical axis washing machines, comprising a rod (1) which slides inside the friction ring (6), said cage (5) comprising a through inner recess, configured to house slidingly the rod (1) of the damper, and to contain the friction ring (6), wherein said through inner recess is subdivided into three parts:

a first part (52) in which said recess is provided with a plurality of inner tongues (521) therein;

a second part (53) having a circular section and an axial diameter and length to house the friction ring (6);

a third part (54) in which said inner recess is provided with a plurality of tabs (541) therein;

and wherein said friction ring (6) cannot slide in an axial direction with respect to the cage (5), being kept in position by said inner tongues (521) and by said tabs (541);

and wherein said rod (1) compresses a spring (4) constrained between a stop (3), mounted on a second end of the rod (1), and a surface (51) of the cage (5), and wherein said rod (1) slides with respect to the friction ring (6); said spring (4) adds elastic forces to friction forces generated by the damper.

2. The cage (5) containing the friction ring of dampers for vertical axis washing machines according to claim 1, wherein the shape and position of said tongues (521) and tabs (541) are such that, in a front view, the side edges of the tongues and tabs coincide, the tongues being positioned inside the free space between two adjacent tabs and vice versa, so that they are not overlapped in a front view.

3. The cage (5) containing the friction ring of dampers for vertical axis washing machines according to claim 2, wherein said tongues (521) have shapes and positions such as the angles relative to the sectors of the tabs (541) and tongues (521) occupy a whole circumference.

4. The cage (5) containing the friction ring of dampers for vertical axis washing machines according to claim 3, wherein said tongues (521) are four in number and said tabs (541) are four in number.

5. A damper for vertical axis washing machines comprising a cage, as described on claim 1.

* * * * *